United States Patent [19]

Andersson et al.

[11] 3,983,788

[45] Oct. 5, 1976

[54] METHOD TO MINIMIZE THE AMOUNT OF OIL IN THE AIR EXHAUSTED FROM A PNEUMATICALLY OPERATED IMPACT MOTOR AND AN IMPACT MOTOR FOR CARRYING OUT THIS METHOD

[75] Inventors: Kurt Holger Andersson, Tyreso; Carl Gosta Bernhard Ekwall, Saltsjobaden; Bo Erik Forsberg, Tyreso; Sven Ingemar Johansson, Saltsjo-Boo, all of Sweden

[73] Assignee: Atlas Copco Aktiebolag, Nacka, Sweden

[22] Filed: Feb. 20, 1975

[21] Appl. No.: 551,355

[30] Foreign Application Priority Data

Feb. 22, 1974 Sweden ..... 7402347

[52] U.S. Cl. ..... 91/46; 91/319; 91/325; 92/86.5; 92/162 R; 92/166

[51] Int. Cl.[2] ..... F01B 31/10; F01L 25/06

[58] Field of Search ..... 91/46, 319; 92/86.5

[56] References Cited

UNITED STATES PATENTS

| | | | |
|---|---|---|---|
| 1,884,652 | 10/1932 | Gordin | 91/46 |
| 1,982,701 | 12/1934 | Smith, Jr. | 91/46 |
| 2,001,746 | 5/1935 | Reilly | 91/46 |

FOREIGN PATENTS OR APPLICATIONS

| | | | |
|---|---|---|---|
| 943,942 | 6/1956 | Germany | 91/319 |

*Primary Examiner*—Paul E. Maslousky
*Attorney, Agent, or Firm*—Flynn & Frishauf

[57] ABSTRACT

An impact motor has a reciprocating piston that has its piston rod guided in bushings in the housing. The bushings are lubricated by oil-loaded compressed air but the piston is forced to reciprocate by oil-free compressed air.

11 Claims, 1 Drawing Figure

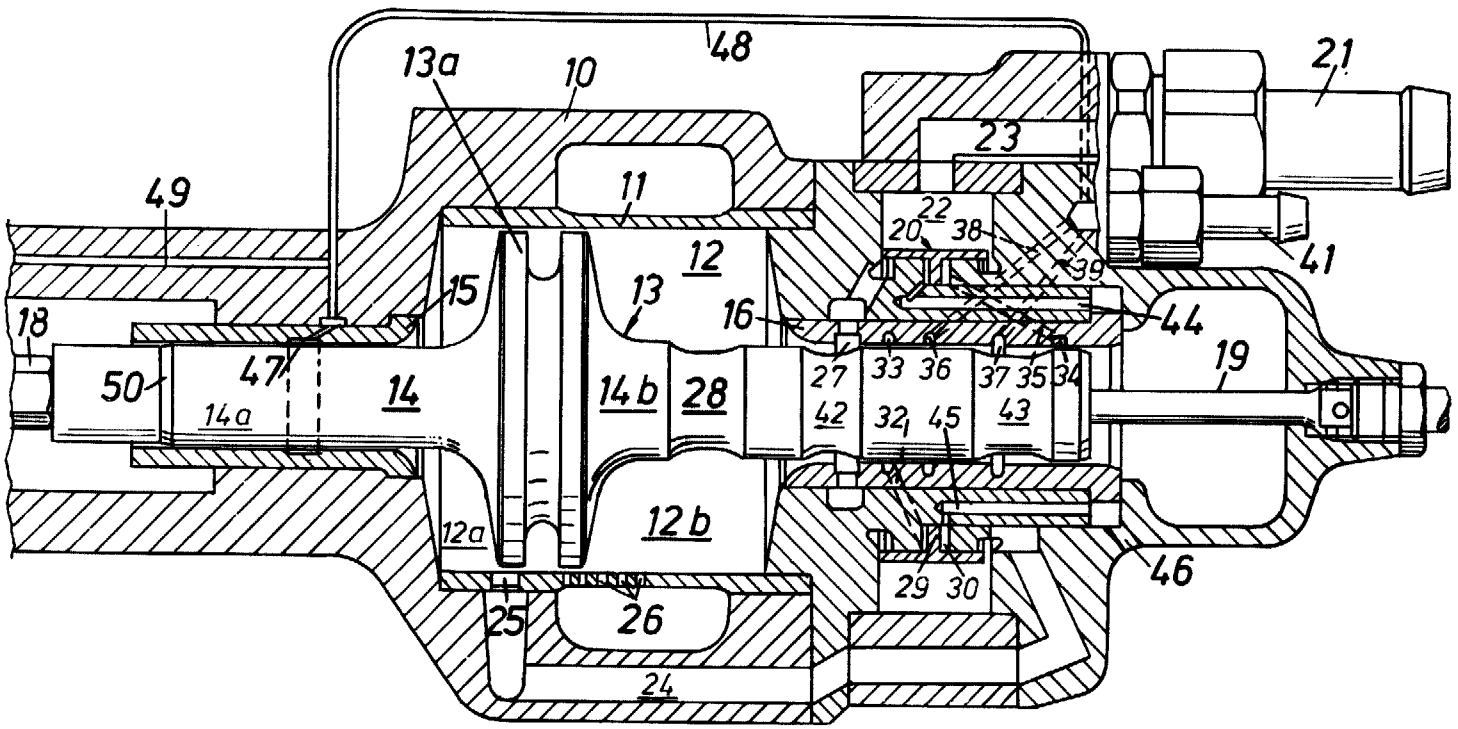
21
41
19
44
46
23
39
38
22
20
34
35
37
43
36
45
33
32
30
29
27
42
16
48
12
28
12b
11
13
14b
26
24
10
25
13a
15
12a
14
47
14a
49
50
18

METHOD TO MINIMIZE THE AMOUNT OF OIL IN THE AIR EXHAUSTED FROM A PNEUMATICALLY OPERATED IMPACT MOTOR AND AN IMPACT MOTOR FOR CARRYING OUT THIS METHOD

The present invention relates to a method to minimize the amount of oil in the air exhausted from a pneumatically operated impact motor and an impact motor intended for carrying out this method. More specifically it is intended by the invention to minimize the amount of oil in the air exhausted from an impact tool of the kind that comprises a housing and a linearly reciprocating hammer piston therein.

BACKGROUND OF THE INVENTION

In conventional impact motors of this type, the hammer piston is guided directly in the drive chamber and in order to ensure the functioning of the impact motor, oil is supplied to the drive air. Not only the oil that is suspended in the drive air in the drive chamber but also a part of the oil that is deposited on the hammer piston and the walls of a drive chamber are drawn out into the atmosphere by the air that exhausts from the drive chamber in each stroke. Of all the oil that in this way continuously leaves the impact motor, the major part is suspended in the air in form of very small particles. This oil dispersed in the air is a very serious hazard to the health of the persons that are in the neighborhood of the impact motor.

It is an object of the invention to solve this problem, and, according to the invention, oil need not be added to the drive air.

BRIEF DESCRIPTION OF THE DRAWING

The single FIGURE is a longitudinal section through an impact motor according to the present invention.

DETAILED DESCRIPTION OF A PREFERRED EMBODIMENT

Referring to the single FIGURE, an impact motor according to the present invention comprises a housing 10 and a lining 11 inserted in the housing to form a drive chamber 12 for a reciprocable hammer piston 13. The hammer piston comprises a drive head 13*a* and a piston rod 14 that extends at both sides from the drive head 13*a* of the hammer piston 13, a forward directed part 14*a* of the piston rod 14 extending forwardly out of the drive chamber 12 and a rearward directed part 14*b* extending rearwardly out of the drive chamber 12. The hammer piston is shown as made out of one piece. Alternatively, the drive head 13*a* can be mounted on the rod 14. The drive head 13*a* divides the drive chamber into a front chamber 12*a* and a rear chamber 12*b*. The piston 13 is guided in the housing 10 by means of its piston rod 14 that cooperates with guiding portions that are arranged in the housing 10 in the form of bushings 15 and 16, in front of and at the rear of the drive chamber 12 respectively as seen in the direction of impact of the piston 13. It is characteristic for the guiding of the hammer piston 13 that the guiding is completely carried out by the bushings 15, 16 whereas the drive head of the piston 13 has no direct contact with the lining 11. This is accomplished by the play or clearance between the bushings 15 and 16 and the piston rod 14 being smaller than the play between the head of the piston 13 and the lining 11.

By its forward end, the hammer piston 13 is arranged to strike the anvil surface of the shank of a tool 18 that is inserted in the forward portion of the housing 10. A flush pipe 19 for the supply of the flushing fluid to the tool 18 is fastened in the rear part of the housing 10 and extends in a conventional manner through the hammer piston 13.

An annular, axially displacable air distributing valve 20 of the seat valve type is disposed in the housing 10. Its object is to distribute compressed air to the front and rear parts 12*a* and 12*b* respectively of the drive chamber 12 in such a way that the hammer piston 13 is forced to reciprocate. To this end, the valve 20 is in communication with a fitting 21 so that it can be supplied with oil free compressed air via an annular chamber 22 and a channel 23.

In one of its two positions, the position that is shown in the FIGURE, the valve 20 permits compressed air to pass from the annular chamber 22 to the front part of the drive chamber 12 so that the hammer piston 13 is forced rearwardly in a return stroke. After passing the valve 20 the compressed air passes through a channel 24 and one or more inlet openings 25 in the lining 11 of the drive chamber. The lining 11 is also provided with a plurality of outlet openings 26.

In its other position, the valve 20 permits compressed air to pass from the annular chamber 22 to the rear part of the guide chamber 12 for forcing the hammer piston 13 forwardly during a work stroke. In this valve position, the annular chamber 22 is in communication with an annular groove 27 in the rear bushing 16. This annular groove 27 is located at a distance from the front end of the bushing 16 and it can therefore be closed off from the drive chamber 12 by the piston rod 14. In order to provide for a supply of compressed air only during a predetermined position interval of the hammer piston 13 without the valve 20 shifting its position, the piston rod 14 of the hammer piston 13 is provided with a waist 28. Supply of air to the rear part of the drive chamber 12 will then only take place when the waist 28 spans the portion of the bushing 16 that separates the annular groove 27 and the drive chamber 12. The valve function for the supply of air to the rear part of the drive chamber is thereby doubled.

Further, the distributing valve 20 has a radially inwardly directed flange 29 which is disposed in a groove 30 in the housing 10. The depth of the groove 30 is equal to the height of the flange 29 whereas its width is much greater than the thickness of the flange. The groove 30 is arranged to communicate with a source of compressed air to thereby actuate the flange 29 of the valve 20 for shifting the position of the valve 20 by air pressure. To this end, one side of the groove 30 is connected to an annular groove 33 in the bushing 16 by means of a channel 32 whereas the other side of the groove 30 is connected to an annular groove 34 in the bushing 16 through a channel 35.

The bushing 16 has two further annular grooves 36 and 37 which, through channels 38 and 39 respectively are continuously connected to a fitting 41 for the supply of oil-loaded compressed air. In order to establish communication between the annular groove 30 and the continuously pressurized air inlet, the piston rod 14 is provided with two further annular waists 42 and 43. By means of the waist 42, the annular grooves 33 and 36 can be interconnected in a certain position of the hammer piston 13, whereby the forward portion of the groove 30 is pressurized and the valve 20 is shifted to its position for effecting its work stroke. The waist 43 is arranged to interconnect the annular grooves 34 and 37 in another position of the hammer piston so that the rear part of the groove 30 is pressurized and the valve 20 is shifted to its position for effecting a return stroke. The annular groove 30 is also connected to the atmosphere through venting channels 44 and 45 and an opening 46.

It is characteristic for the impact motor according to the invention that the compressed air for driving the hammer piston is free from oil whereas a separate lubricating system is arranged to supply a lubricant to the portions in the housing 10 that guide the piston rod 14; namely the bushings 15 and 16. In the impact motor shown in the FIGURE, this lubricating system comprises means to supply oil-loaded compressed air to the bushings 15 and 16. In this impact motor, the oil-carrying compressed air is utilized also in the servo circuit that is intended to shift the position of the distribution valve 20, and, by this arrangement, the valve will also be lubricated. The volume of the oil-carrying compressed air is only about 10% of the air volume totally consumed by the impact motor. Moreover, the oil that is supplied as a mist is deposited in the impact motor and transformed almost completely into non-mist form.

To accomplish the lubrication of the forward guide bushing 15, this bushing is provided with an annular groove 47 that communicates with a lubricating air channel 48 in the housing 10. For clarity, this lubricating air channel 48 is shown outside the housing. The channel 48 is directly connected to the fitting 41. By another lubricating air channel 49, a lubricant can be supplied to a non-illustrated tool holding sleeve and also to other non-illustrated elements at the forward end of the impact motor. In order to ensure a flow of oil-carrying compressed air to the bushing 15, the diameter of the foremost portion of the piston rod 14 is reduced. This reduced portion of the piston rod extends rearwardly from the end of the piston rod to a shoulder 50 which is so located that it uncovers the annular groove 47 when the hammer piston is near its rear turn point. By this arrangement, oil is fed also into the forward portion of the housing for lubricating the tool shank.

With reference to the FIGURE, the operation of the impact motor will be described.

In the FIGURE, the hammer piston 13 is shown in its position of impact. In this position, the valve 20 has its position for effecting a return stroke and it supplies air to the front portion 12*a* of the drive chamber 12 through the channel 24 and the port 25. In this way, the hammer piston 13 continues its return stroke until the waist 42 of the piston rod simultaneously uncovers the annular grooves 33 and 36 in the bushing 16 so that compressed air is supplied to the front part of the annular groove 30, and the valve 20 shifts into its position for effecting a work stroke. Now the annular groove 27 in the bushing 16 is pressurized. However, this groove 27 is closed off from the drive chamber 12 by the piston rod 14 so that no drive air can flow into the drive chamber 12. Instead, the hammer piston 13 continues its return stroke so that the outlet ports 26 are uncovered by the piston 13 and the forward portion 12*a* of the drive chamber 12 is relieved of pressure. When the hammer piston moves a little further, the rear end of the waist 28 of the piston rod coincides with the annular groove 27 and drive air can start to flow into the rear part of the drive chamber 12 via the waist 28.

However, the hammer piston 13 has normally received such an amount of kinetic energy during its return stroke that it will continue still a distance further so that the front end of the waist 28 will pass the forward end of the bushing 16 and the connection with the source of compressed air will again be broken. The rear part of the drive chamber is now completely closed and an air cushion is entrapped to form an elastic stop for the hammer piston 13. Thus, the hammer piston bounces against an air cushion in its rear end position and it receives so to speak a flying start in its subsequent stroke.

During the first portion of the work stroke, the connection between the drive chamber 12 and the source of compressed air is again opened by the waist 28. The hammer piston 13 is now forced forwardly by virtue of the compressed air that flows into the drive chamber until the rear end of the waist passes the annular groove 27 so that the supply of compressed air is interrupted. The hammer piston 13 will now continue while the air in the rear part 12*b* of the drive chamber 12 expands.

In the subsequent phase, the hammer piston 13 uncovers the outlet ports 26 so that the rear part of the drive chamber 12 is relieved of pressure.

When the work stroke has continued a distance further, the waist 43 of the piston rod 14 uncovers the annular groove 37, that is continuously pressurized, so that compressed air can flow into the annular groove 34 and from there via the channel 35 to the annular groove 30 and the position shifting flange 29 of the air distributing valve 20. As a result, the valve 20 shifts into its position for effecting a return stroke and conveys compressed air out through the channel 24 and the port 25 to the forward portion 12*a* of the drive chamber 12. The valve 20 maintains its position until the hammer piston 13 has turned and reached, during its return stroke, the position in which the waist 42 of the piston rod 14 simultaneously uncovers the annular grooves 33 and 36 in the bushing 16 so that the valve 20 again shifts into its position for effecting a work stroke.

If the hammer piston 13 encounters too small a resistance during its work stroke such as when there is no shank to strike, it will pass and cover the inlet port 25 so that an air cushion will be trapped in the front portion of the drive chamber 12 and the hammer piston 13 will turn by bouncing against this air cushion. However, the normal impact position of the hammer piston 13 is the position shown in the FIGURE.

The essence of the present invention is that the hammer piston is guided in the housing by its piston rod and that oil-free compressed air is utilized to drive the piston. One condition for this is that the hammer piston has no direct contact with the wall of the drive chamber so that no lubricating of the drive head of the piston is necessary. A lubricant is instead supplied selectively to the portions for guiding the piston rod.

Oil-free working of the hammer piston is made possible by having the play or clearance between the piston rod and its guiding portions of the housing, e.g. the bushings 15 and 16, smaller than the play or clearance between the piston and the wall of the drive chamber.

The invention is not limited to the illustrated embodiment but can be freely varied within the scope of the claims.

What we claim is:

1. Method to minimize the amount of oil in the air exhausted from a pneumatically operated impact motor comprising:

mounting a hammer piston having an interconnected drive head and piston rod in a housing having a drive chamber such that the drive head is reciprocably mounted in the drive chamber with a clearance between the drive head and the inner wall of the drive chamber, said piston rod extending out of the drive chamber in at least one direction;

passing said piston rod through at least one guide portion in said housing with a clearance therebetween for guiding said hammer piston in its reciprocatory movement;

maintaining said drive head of said piston out of direct contact with the wall of the drive chamber by dimensioning said piston rod and said at least one guide portion such that said clearance between said piston rod and said at least one guide portion is smaller than said clearance between said drive head and the wall of the drive chamber;

supplying said drive chamber with substantially oil-free compressed air for actuating the hammer piston;

supplying lubricant to said at least one guide portion; and substantially blocking lubricant flow from said at least one guide portion to said drive chamber so as to maintain the air in said drive chamber substantially lubricant free.

2. Method according to claim 1 wherein said lubricant supplied to said at least one guide portion is carried by compressed air.

3. Method according to claim 2 comprising supplying the lubricant-carrying compressed air to an air distributing valve which is separate from the hammer piston to shift the position of the valve.

4. Method according to claim 2 comprising supplying the lubricant-carrying compressed air to an air distributing valve which is separate from the hammer piston to lubricate the valve.

5. Pneumatically operated impact motor, comprising:

a housing with a drive chamber therein;

a hammer piston having a drive head which is reciprocably mounted in said drive chamber with a clearance between said drive head and the wall of said drive chamber, said hammer piston comprising a piston rod that extends out of the drive chamber;

said housing comprising at least one guide portion for guiding the piston rod with a clearance between said at least one guide portion and said piston rod;

said piston rod and said at least one guide portion being dimensioned such that said clearance between the piston rod and said at least one guide portion is smaller than said clearance between the piston head and the wall of the drive chamber to prevent direct contact between the piston head and the wall of the drive chamber;

passage means for supplying a lubricant to said at least one guide portion for guiding the piston rod;

means for supplying substantially oil-free compressed motive fluid to said drive chamber to actuate said hammer piston; and means for substantially blocking lubricant flow from said at least one guide portion to said drive chamber.

6. Impact motor according to claim 5, wherein said hammer piston has a further piston rod which extends out of the drive chamber in a direction opposite to that of the first-mentioned piston rod, and wherein the housing has a further guide portion cooperating with said further piston rod with a clearance therebetween, said clearance between said further piston rod and said further guide portion being smaller than said clearance between the piston head and the wall of the drive chamber.

7. Impact motor according to claim 6 comprising a distributing valve for the motive fluid, said valve being separate from the hammer piston, and passages for supplying a lubricant to the valve, said passages for supplying lubricant to the valve and to said at least one guide portion being connected to a common supply passage for oil-loaded compressed air.

8. Impact motor according to claim 6 comprising a separate distributing valve for the motive fluid, and a control circuit air coupled to the distributing valve to shift the position of the distributing valve, said control circuit air being separate from the means for supplying said motive fluid.

9. Impact motor according to claim 5 wherein said means for supplying said motive fluid comprises means for supplying compressed air, said impact motor further comprising a separate distributing valve for the compressed air, and a circuit for control air coupled to the separate compressed air distributing valve to shift the position of the separate compressed air distributing valve, said circuit for control air being separate from said means for supplying said compressed air.

10. Impact motor according to claim 5 wherein said motive fluid is compressed air, and comprising a distributing valve for the compressed air, said distributing valve being separate from the hammer piston, and passages for supplying a lubricant to the distributing valve, said passages for supplying lubricant to the distributing valve and to said at least one guide portion being connected to a common supply passage for oil-loaded compressed air.

11. Impact motor according to claim 5 wherein said motive fluid is compressed air.

* * * * *